United States Patent [19]

Tham

[11] 3,987,851

[45] Oct. 26, 1976

[54] SERIALLY BURNING AND PYROLYZING TO PRODUCE SHALE OIL FROM A SUBTERRANEAN OIL SHALE

[75] Inventor: Min Jack Tham, Houston, Tex.

[73] Assignee: Shell Oil Company, Houston, Tex.

[22] Filed: June 2, 1975

[21] Appl. No.: 583,123

[52] U.S. Cl. ..... 166/256; 166/272

[51] Int. Cl.[2] ..... E21B 43/24

[58] Field of Search ..... 166/256, 258, 272, 302, 166/303, 306

[56] References Cited

UNITED STATES PATENTS

| | | | |
|---|---|---|---|
| 3,171,479 | 3/1965 | Parrish et al. | 166/261 |
| 3,196,945 | 7/1965 | Craig et al. | 166/261 |
| 3,322,194 | 5/1967 | Strubhar | 166/303 |
| 3,454,958 | 7/1969 | Parker | 166/303 |
| 3,465,818 | 9/1969 | Dixon | 166/303 |
| 3,548,938 | 12/1970 | Parker | 166/272 |
| 3,586,377 | 6/1971 | Ellington | 166/272 |
| 3,700,280 | 10/1972 | Papadopoulos et al. | 166/303 |
| 3,779,602 | 12/1973 | Beard et al. | 166/303 |

*Primary Examiner*—Ernest R. Purser
*Assistant Examiner*—Jack E. Ebel

[57] ABSTRACT

A process for producing shale oil by circulating hot fluid through a rubble-containing cavern within a subterranean oil shale which contains water-soluble mineral is improved by burning a carbonaceous residue left within one cavity to produce hot fluid for operating power devices and also pyrolyzing the oil shale in a different cavity.

6 Claims, 3 Drawing Figures

SERIALLY BURNING AND PYROLYZING TO PRODUCE SHALE OIL FROM A SUBTERRANEAN OIL SHALE

BACKGROUND OF THE INVENTION

The invention relates to producing shale oil and related mineral materials from subterranean deposits of oil shale.

Numerous subterranean oil shales are mixed with water-soluble minerals. Such deposits comprise substantially impermeable, kerogen-containing, earth formations from which shale oil can be produced by a hot fluid-induced pyrolysis or thermal conversion of the organic solids to fluids. A series of patents typified by the T. N. Beard, A. M. Papadopoulos and R. C. Ueber U.S. Pat. Nos. 3,739,851; 3,741,306; 3,753,594; 3,759328; and 3,759,574 describe procedures for utilizing the water-soluble minerals to form rubble-containing caverns in which the oil shale is exposed to a circulating hot aqueous fluid that converts the kerogen to shale oil while removing enough solid material to expand the cavern and expose additional oil shale.

SUMMARY OF THE INVENTION

This invention relates to producing shale oil. At least two cavities are formed within a subterranean oil shale deposit which contains water-soluble mineral. The soluble mineral in and around each cavity is leached with an aqueous fluid hotter than the surrounding oil shale, to form a permeable oil shale rubble within each cavity. An underground combustion is initiated and a combustion front is advanced through the permeable oil shale rubble in at least one cavity. The hot fluid produced by the combustion is circulated through the permeable oil shale rubble in at least one cavity, preferably while that rubble is still hotter than the surrounding oil shale. And, shale oil is recovered from fluid produced from at least one cavity.

DESCRIPTION OF THE INVENTION

The present invention is, at least in part, premised on the following discovery. In a subterranean oil shale which contains water-soluble minerals, the relative magnitudes of permeabilities, flow rates, and hydrocarbon residues which can be feasibly formed or utilized, are such that a significant saving in the energy required to produce the shale oil can be effected by a serial burning and pyrolyzing. When at least two cavities are formed and leached so that they contain permeable oil shale rubble and the rubble in one cavity is pyrolyzed to produce shale oil, an underground combustion of the residual carbon left in that rubble can form the hot fluid to be used for pyrolyzing the oil shale rubble in a different cavity. Such combustion products can provide enough heat and hot fluid to also operate power-driven compressors, pumps and the like devices in the vicinity of the subterranean oil shale.

Figure 1:
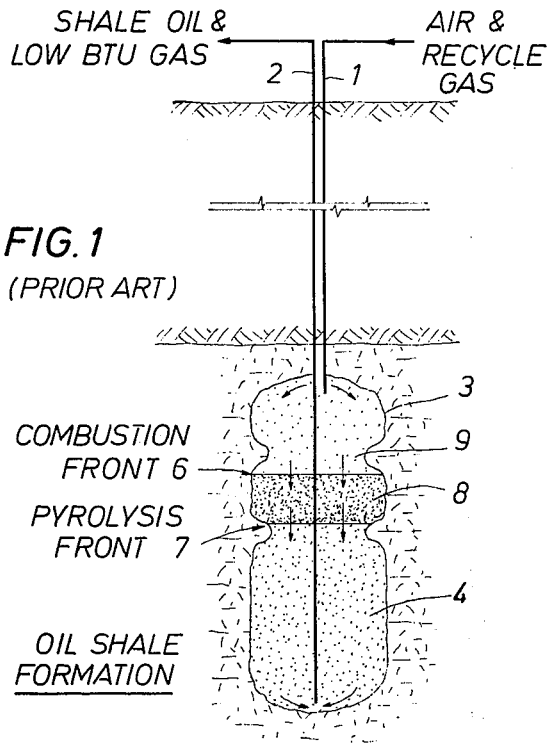
FIG. 1 (PRIOR ART)
FIG. 1 is a schematic illustration of an oil shale formation containing a cavity being used for a conventional type of underground pyrolysis for shale oil recovery.

The serial burning and pyrolyzing also avoids a disadvantage that is inherent in a conventional underground combustion-heated pyrolysis of a permeable oil shale rubble. A conventional process is illustrated by FIG. 1. After an underground combustion is initiated, a combustion front is advanced by injecting a combustion-supporting fluid, such as air or a mixture of oxygen and air in through conduit. Concurrently a fluid, such as a mixture of shale oil and low BTU gas (mainly combustion products) are outflowed through conduit 2. As known to those skilled in the art, a cavity 3 can readily be formed and leached so that its solids content is primarily a permeable rubble of oil shale 4. In such a cavity, an inflowing combustion-supporting gas can cause a combustion front 6 to advance through the rubble. The hot gas formed by the combustion pyrolyzes the oil shale in a region downstream from the combustion. This forms a pyrolysis front 7 and a region of pyrolyzed oil shale 8 ahead of the combustion front. The combustion burns the carbonaceous residue left by the pyrolysis and leaves a zone of depleted oil shale solids 9 behind the combustion front.

An inherent disadvantage of such a combustion-heated pyrolysis process is the tendency for the hot gas formed by the combustion to channel (or flow preferentially) through the most permeable portions of the rubble of oil shale. This causes oil or incompletely pyrolyzed oil shale (or kerogen) to remain unpyrolyzed until is is reached by and consumed in the advancing combustion front (where most of the organic material is converted to oxides of carbon, hydrogen or nitrogen, or other components of a low BTU gas).

The present process avoids such a combustion of shale oil raw materials. In addition, any oil shale that is initially bypassed is heated by the inflowing hot gas passing near it. Thus, any bypassed oil shale tends to be subsequently pyrolyzed without being destroyed by combustion.

As used herein "oil shale" refers to a substantially impermeable aggregation of inorganic solids and a solid predominately hydrocarbon-solvent-insoluble organic material known as "kerogen". "Bitumen" refers to the hydrocarbon-solvent-soluble organic material that may be initially present in an oil shale or may be formed by a thermal conversion or pyrolysis of kerogen. "Shale oil" refers to gaseous and/or liquid hydrocarbon materials (which may contain trace amounts of nitrogen, sulfur, oxygen, or the like) that can be obtained by distilling or pyrolyzing or extracting organic materials from an oil shale. "Water-soluble inorganic mineral" refers to halites or carbonates, such as the alkali metal chlorides, bicarbonates or carbonates, which compounds or minerals exhibit a significant solubility (e.g., at least about 10 grams per 100 grams of solvent) in generally neutral aqueous liquids (e.g., those having a pH of from about 5 to 8) and/or heat-sensitive compounds or minerals, such as nahcolite, dawsonite, trona, or the like, which are naturally water-soluble or are thermally converted at relatively mild temperatures (e.g., 500° to 700° F) to materials which are water-soluble. The term "water-soluble-material-containing oil shale" refers to an oil shale that contains or is mixed with at least one water-soluble inorganic mineral, in the form of lenses, layers, nodules, finely-divided dispersed particles, or the like. A "cavern" or "cavity" (within a subterranean oil shale formation) refers to a relatively solids-free opening or void in which the solids content is less than about 60% (preferably less than about 50%)

and substantially all of the solids are pieces which are surrounded by fluid, are relatively movable, and are substantially free of the lithostatic pressures caused by the weight of the overlying rocks.

In the present process, the cavities in an oil shale can readily be formed by conventional procedures. A small cavity is formed by drilling a borehole. It can be enlarged by under-reaming, solution-mining, hydraulic or explosive fracturing, or the like operations. Where desirable, acids and/or viscous fluids can be utilized to dissolve and/or entrain solids to increase the volume of solid-free space within a cavity.

The solution-mining of water-soluble minerals by circulating hot aqueous fluids through an initially relatively small cavity (such as an under-reamed portion of a borehole) is a particularly preferred procedure for concurrently expanding the volume of a cavity and leaching the water-soluble minerals to form a permeable oil shale rubble within the cavity. The T. N. Beard, P. vanMeurs U.S. Pat. No. 3,779,602 describes a particularly suitable process for solution-mining bicarbonate minerals by circulating hot water at a pressure that is optimized for enhancing the growth of a permeable rubble-containing cavity. The L. H. Towell and J. R. Brew U.S. Pat. No. 3,792,902 describes such a solution-mining process in which plugging due to mineral precipitation is minimized by mixing an aqueous diluent with downhole portions of the out-flowing fluid. In general, the solution-mining fluid can be substantially any aqueous liquid (which is preferably slightly acidic or neutral) that tends to dissolve the water-soluble mineral without damaging the well conduits. Such a fluid is preferably circulated at a temperature, of from about 200° F to 400° F, that exceeds the temperature of the adjacent portions of the subterranean oil shale formation.

Where the cavity in the oil shale formation is initially a substantially vertical section of a well borehole, the leaching fluid is advantageously injected into the cavity at a point near the bottom, while the mineral-laden solution is withdrawn from a point near the top. The points of injection and withdrawal can be reversed and the flow rate can be cyclically changed, both in direction and rate. The leaching is preferably continued to provide a cavity that contains a permeable oil shale rubble and has a suitable volume. As the leaching fluid contacts the oil shale in and along the walls of the cavity, soluble materials are dissolved from the contacted portions. This imparts permeability. Where the distribution of the water-soluble mineral is non-uniform, the leaching-out of streaks or layers may cause the collapse of chunks of oil shale that become more permeable as the leaching continues. Along the walls, the rate of leaching tends to decrease with increases in the size of the cavity.

In general, the mineral-leaching should be continued until the cavity radius is on the order of 40 to 50 feet or more, preferably at least 100 feet. The cavity vertical height should be at least about 200 feet, and preferably at least about 500 feet. The average permeability of the pieces of leached oil shale formation within the cavity and along the innermost portions of the cavity walls should be at least about 1 and preferably 10 or more darcies (1,000 to 10,000 or more millidarcies).

The minerals dissolved during the leaching operation can, of course, be recovered (by means known to those skilled in the art) and can provide valuble by-products to the recovery of shale oil. In general, during the leaching process some (but relatively small amounts of) shale oil is entrained with and can be recovered from the fluid circulated to effect the leaching operation.

The oil shale kerogen in the permeable rubble left in the cavity by the leaching process is pyrolyzed by circulating a relatively hot pyrolyzing fluid through the cavity. The circulation flow path can be upward (in at the bottom and out at the top) or downward, or alternated between the two, and the flow rate can be varied or reversed, as desired. The pyrolyzing fluid can be gaseous or liquid (at the pressure within the cavity) and should have a temperature exceeding that of the surrounding oil shale formation, such as a temperature of from about 450° F to 1000° F. The pyrolyzing fluid can be composed of normally liquid or gaseous components which (by means of thermal, chemical and/or solvent action) interact with the organic components (primarily kerogen) of the oil shale and dissolve or entrain shale hydrocarbon materials. Suitable pyrolyzing fluids comprise steam, or mixtures of steam and hydrocarbons, or hydrocarbon combustion products, hot aqueous fluids, and mixtures of such fluids with liquid or gaseous hydrocarbons or the product of their combustion, liquid or gaseous oil solvents or the like.

Figure 2:
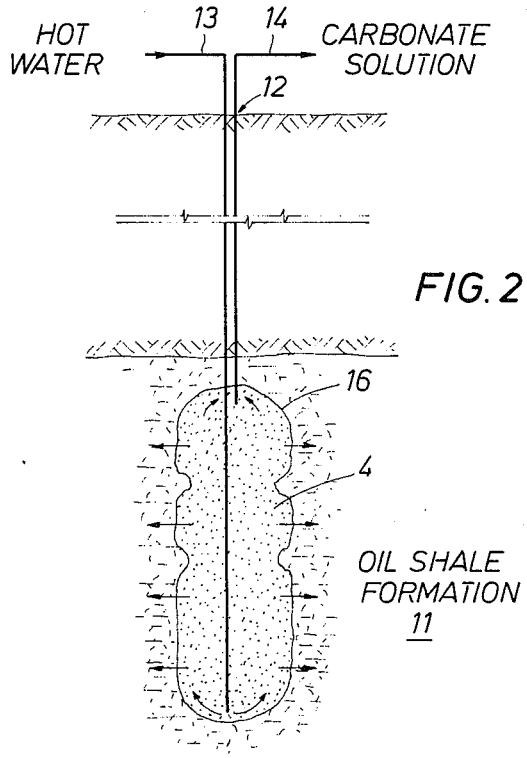
FIGS. 2 and 3 are schematic illustrations of an oil shale formation containing cavities being used in various stages of the present invention.

FIG. 2 shows the first stage of a preferred operation of the present process. At least two wells, spaced apart by at least several hundred feet, are drilled into an oil shale formation 11. The exemplified formation is 500 feet thick, contains about 25% by weight of nahcolite in a relatively uniform distribution, and has a kerogen richness of about 25 gallons per ton by Fischer assay. Well 12 is drilled substantially through the formation and equipped with an inflow conduit 13 opening near the bottom of the formation and outflow conduit 14 opening near the top of the formation.

Relatively fresh water at a temperature of 300° F is injected through conduit 13 while the resulting solution is produced through conduit 14. This leaches the soluble minerals from the oil shale exposed within and along the wall of the borehole. It is expected that with a flow rate of about 10,000 barrels per day, in about 4 years such a circulation can expand the borehole into cavity 16 having a diameter of about 200 feet and a height of about 500 feet. Such a cavity will be filled with a permeable oil shale rubble having an average permeability in the order of 1,000 millidarcies.

The hot aqueous solution that fills the cavity at the end of the leaching operation is preferably displaced by a gas such as a recycle gas. The solution-displacing gas preferably has a temperature high enough and/or a heat capacity low enough so that no significant proportion of the heat imparted to the oil shale rubble in the cavity is lost in heating the inflowing fluid.

In the next step, an underground combustion is initiated in and advanced through the oil shale rubble in such cavity. This can be done by a conventional combustion-pyrolysis process of the type illustrated in FIG. 1. The oil in a portion of the permeable rubble 4 near the top of the cavity is heated to substantially its ignition temperature. A combustion-supporting mixture of oxygen-containing gas, such as compressed air, is injected into the heated oil shale rubble to initiate an underground combustion. As shown in FIG. 1, the continued air injection advances a combustion front 6 down through the mass of rubble. The injection rates and pressures are preferably controlled to maintain a combustion front temperature in the order of 800° to 900° F. The hot gas produced by the combustion moves ahead of the front and pyrolyzes the oil shale that it contacts. The pyrolysis front 7 tends to move along ahead of the combustion front while leaving a zone of pyrolyzed oil shale which contains a carbonaceous material residue that serves as the fuel for the combustion. The combustion tends to leave a mass of pyrolyzed and burned inorganic material (spent rubble) 9 having a relatively low permeability (in the order of 10 to 50 millidarcies). In such a down-flow underground combustion pyrolysis, the shale oil components are withdrawn from near the bottom of the cavity.

It has now been discovered that even if both the pyrolysis and combustion fronts maintain a piston-like advancement (with substantially no by-passing) a significant amount of available heat energy would be wasted. If the hot gas pyrolysis front 7 moves throughout the cavity about 80% of the Fischer assay oil might be recovered. This would leave behind 0.4 MMB (million barrels) of shale oil in the form of hydrocarbons, carbonaceous residue or heat. The amount left is 0.656 barrels of liquid fuel equivalent (LFE) per barrel of oil recovered. Since the energy requirements for the leaching and hot gas pyrolysis are only 0.45 barrel LFE per barrel of oil recovered by the hot gas pyrolysis, the amount of fuel left is more than enough to supply the energy required to conduct the leaching and pyrolyzing. The 0.45 barrel LFE per barrel of oil recovered includes the energy for leaching, heating hot gas and running all powered machines, like compressors, etc. An equivalent number for the conventional oil shale process is 0.59 barrel LFE per barrel of oil recovered. The latter (energy) requirement for the combustion process is at least partly due to the fact that larger compressors are required.

Figure 3:
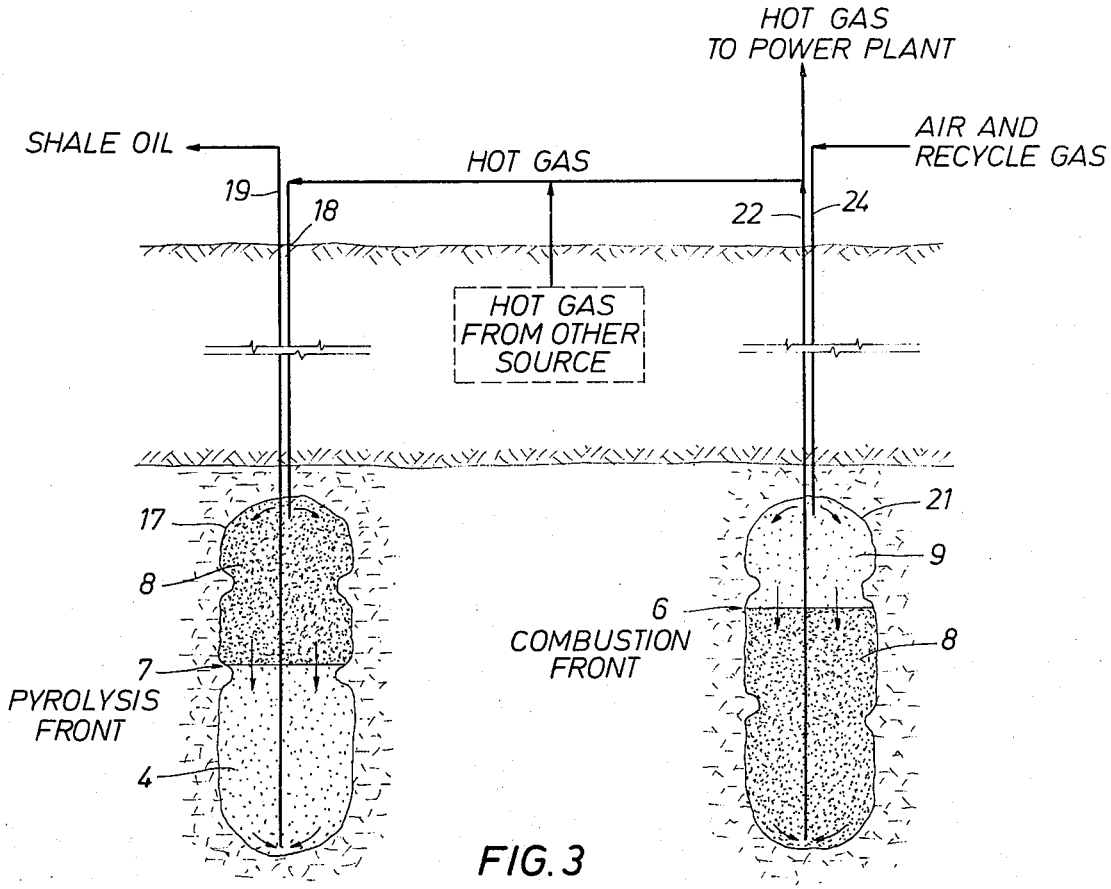

FIG. 3 shows a stage of the present process in which the fuel left by a pyrolysis in one cavity is being used to conduct a hot gas pyrolysis in another cavity. Cavity 17 has been formed and leached so that it is filled with a permeable oil shale rubble 4 which is hotter than the surrounding oil shale formation (e.g., by the procedure described in connection with cavity 16 in FIG. 2). A hot gas, which can be a mixture of shale oil and low BTU gas produced by an in situ combustion process of the type shown in FIG. 1, is injected into the top of the cavity through conduit 18 while shale oil-containing fluid is produced through conduit 19.

Such a hot gas is preferably injected at a temperature of at least about 450° F (preferably 800° F) which is hotter than the oil shale rubble within the cavity. Where the hot gas is produced by a combustion front preceded by a pyrolysis front (as shown in FIG. 1) at least a significant portion of the shale oil that is mixed with the hot gas is preferably removed prior to injecting the gas into cavity 17. Such a shale oil separation can be effected by means known to those skilled in the art. The hot gas injection into cavity 17 causes the pyrolysis from 7 to advance through the cavity while leaving a mass of pyrolyzed oil shale 8. Cavity 21, which was initially filled with pyrolyzed oil shale rubble 8, is a residual fuel-containing cavity of the type that cavity 17 will become when its pyrolysis has been completed.

In a particularly preferred procedure for conducting the present invention at least 3 cavities are formed and leached to form permeable oil shale rubble-containing cavities such as cavity 16 (in FIG. 2). One such cavity is treated by a combination combustion-pyrolysis of the type applied to cavity 3 (in FIG. 1) to provide a source of hot gas for a pyrolysis as shown in cavity 17 (in FIG. 3). The resultant pyrolyzed oil shale rubble is then burned as shown in cavity 21 (FIG. 3) i.e., by initiating an underground combustion and advancing a combustion front 6 through the cavity to provide hot gas to be used in the pyrolysis, e.g., in cavity 17. A significant proportion of the hot gas produced from the combustion in cavity 21 can advantabeously be divided and supplied to a power plant.

As known to those skilled in the art the products of a combustion such as that shown in cavity 21, are composed mainly of the oxides of carbon, hydrogen and nitrogen and contain relatively small proportions of hydrocarbons or other contaminates. The pressure and temperature of such combustion products can be adjusted by controlling the composition and pressure of the combustion-supporting gas injected through conduit 24 and the backflow pressure applied to production conduit 22. A division of a combustion gas stream so that about 44% by volume is injected into cavity 17 while about 56% is transported to the power plant is generally suitable. The combustion-supporting gas supplied to cavity 21 can advantageously be a mixture of air and a recycle gas that is derived from portions of a previously produced combustion product that has been used in a power plant and/or has operated power-driven devices. Such a recycle gas can also comprise portions of the non-hydrocarbon components of the pyrolysis reaction products of a pyrolysis such as is shown in cavity 17.

In one embodiment of the present invention the hot gas used to effect the pyrolysis reaction in cavity 17 consists essentially of steam which was generated in a cavity in which an underground combustion is conducted. The steam can be formed by continuously or intermittently mixing water with the combustion-supporting gas supplied to cavity such as cavity 21. This provides a so-called wet combustion as the water is carried into combustion front 6 and is there converted to steam. Alternatively, or additionally, the steam can be formed by continuously or intermittently injecting steam into the top of cavity 21 through an additional conduit (not shown). It has been found that the spent oil shale left by leaching, pyrolyzing and then burning decreases in bulk volume to an extent that tends to create a void in the top of a cavity such as cavity 21. Water can be injected into such a void space through a spray nozzle or sprinkler device. The injected water will turn into steam when it reaches a hotter part of the cavity.

Where steam is used as the hot gas to effect the pyrolysis in cavity 17 the carbonaceous residue that remains is sufficient to support a subsequent combustion that will supply the hot gas for the pyrolysis in a different cavity. At the completion of a pyrolysis with steam it is estimated that approximately 0.48 MMB of LFE will be left in a cavity (i.e., the equivalent of 0.96 barrels of LFE per barrel of oil recovered). In such a steam pyrolysis the flow within the cavity can be either an upflow or downflow. Following a steam pyrolysis the cavity is preferably pressureized with an inert gas, such as recycle gas, to displace any water or carbonate solution that remains.

What is claimed is:

1. In a process for producing shale oil from a subterranean oil shale formation that contains water-soluble material by forming a cavity within the oil shale formation, leaching water-soluble mineral to form a permeable oil shale rubble within the cavity, and circulating hot fluid through the cavity to pyrolyze the permeable oil shale rubble and recover shale oil, the improvement which comprises:

forming at least two cavities;

leaching water-soluble minerals by circulating aqueous liquid which is hotter than the surrounding oil shale through at least two cavities to form a relatively hot permeable oil shale rubble in each cavity;

initiating an underground combustion and advancing a combustion front through at least one cavity containing a permeable oil shale rubble or a pyrolyzed oil shale rubble that contains carbonaceous material;

circulating hot combustion products composed mainly of the oxides of carbon, hydrogen and nitrogen formed by said underground combustion through the permeable oil shale rubble in at least one of said cavities; and recovering shale oil from at least one fluid produced from at least one of said cavities.

2. The process of claim 1 in which said circulation of hot combustion products is initiated while the permeable oil shale rubble being treated is hotter than the surrounding oil shale.

3. The process of claim 1 in which some of the hot fluid formed by the underground combustion is conveyed to at least one hot fluid-operated device in a surface location near the subterranean oil shale formation.

4. The process of claim 1 in which at least one underground combustion is conducted in a cavity in which the permeable oil shale rubble has been previously pyrolyzed by injecting hot fluid that was formed by an underground combustion in a different cavity.

5. The process of claim 1 in which the underground combustion in at least one cavity is supported by injecting a combustion-supporting gas containing a mixture of oxygen and water to provide a hot fluid consisting essentially of a mixture of steam and shale oil hydrocarbon combustion products and said mixture is used as the hot combustion products circulated through oil shale rubble.

6. The process of claim 1 in which the liquid remaining in said cavities after the leaching of water-soluble minerals is displaced by injecting a substantially inert gaseous fluid so that at least most of the temperature attained during the leaching is retained within the cavity prior to initiating an underground combustion or pyrolysis of the permeable oil shale rubble within the cavity.

* * * * *